US005918316A

United States Patent [19]

Nathanson et al.

[11] Patent Number: 5,918,316

[45] Date of Patent: Jul. 6, 1999

[54] PROMOTIONAL CLIP-ON ACCESSORY FOR ADJUSTABLE CAPS

[76] Inventors: Theodore Nathanson, 352 D. Central Ave., Scarsdale, N.Y. 10583; Peter H. Jeffer, 15 Gay St., New York, N.Y. 10014

[21] Appl. No.: 08/888,746

[22] Filed: Jul. 7, 1997

[51] Int. Cl.[6] ..... A42B 1/24

[52] U.S. Cl. ..... 2/209.13; 2/244; 40/329; 40/672; 229/922

[58] Field of Search ..... 2/209.13, 244, 2/246, 195.1, 195.2; 40/329, 360, 672, 124.09; 223/87; 229/92.8, 922

[56] References Cited

U.S. PATENT DOCUMENTS 3,862,687 1/1975 Pirman ..... 223/87
5,010,669 4/1991 Moran ..... 229/92.8

*Primary Examiner*—Diana L. Biefeld
*Attorney, Agent, or Firm*—Law Offices of Royal W. Craig

[57] ABSTRACT

A promotional clip-on accessory which is adapted to fold around a cap strap to carry a display panel thereon for displaying promotional material. The clip-on accessory is die cut from a vinyl plastic or cardstock sheet and is pre-scored to include two bi-fold hinges defining a central display panel and two opposite folding panels that are folded around the cap strap. A locking tab configuration is also disclosed for securing the accessory on the cap strap. A push-out outlocking tab is cut into one panel and, once the lower and upper panels have been folded around the back of the cap strap, may be pushed through a second tab in the opposing panel to lock the accessory in position around the cap strap. The accessory may also be cut to form a customized pop-out section which remains erect and coplanar with the front display panel after the accessory is applied to a cap strap, which gives the image of a front display panel custom cut in the shape of a design indicia.

4 Claims, 6 Drawing Sheets

PROMOTIONAL CLIP-ON ACCESSORY FOR ADJUSTABLE CAPS

BACKGROUND OF THE INVENTION

1. Field of the Invention

The present invention relates to promotional clip-on accessories for attachment to clothing and, more particularly, to a clip-on accessory for adjustable caps that carries an integral display panel for promotional purposes.

2. Description of the Background

Manufacturers and retailers routinely promote their products with colorful attention-grabbing labels including advertisements, names, logos, etc. A significant industry has evolved around the use of "trim" (including labels, hang-tags, etc.), "gifts-with-purchase" (e.g., a variety of inexpensive novelty items), and like accessories all for conveying promotional information.

One example of an accessory which is gaining in popularity is an advertising clip or plate which may be attached to the rear strap of an adjustable cap.

Prior art means for attachment of accessories to hats include U.S. Pat. No. 4,905,406 to Warner, which shows a clip-on member coated with an insect attractant for clipping onto a hat. The clip may be a spring clip or an alligator clip, or a head-encircling spring structure.

U.S. Pat. No. 1,294,595 to Allen teaches an internal markers for dress hats and coats formed of a flexible sheet material capable of being cut or stamped out. U.S. Pat. No. 2,181,446 to Ames shows a cap with a removable head band 10 and visor 15.

U.S. Pat. No. 1,559,917 to Schnebel shows a hat with a projection means for attachment to a band.

Similarly, the concept of providing attachments to hats has been applied in the different context of exterior clips for advertising purposes. This is shown by U.S. Pat. No. 5,519,892 and U.S. Pat. No. 5,003,640 to Pizzacar, U.S. Pat. No. 5,519,891 to Peters et al., and U.S. Pat. No. 5,499,402 to Rose. Each of these patents discloses an attachment for the strap of an adjustable cap which serves to display a logo, advertisement, or other indicia. Preferably, this type of accessory should be flashy and eye catching, durable, simple to attach (yet securely attachable to withstand athletic events and the like), and extremely inexpensive to manufacture in bulk. Collectively, the above-referenced patents disclose a number of attachment means for securing an accessory onto the strap of an adjustable cap.

Specifically, Pizzacar '640 discloses an advertising nameplate that attaches to the strap of an adjustable cap by means of mounting bars (FIG. 2), a hook and loop fastening device (FIG. 7), or by means of holes provided in the nameplate for engagement with the projections on one of the straps (FIG. 8).

Pizzacar '892 discloses a cloth advertising nameplate for attachment to the headband of an adjustable cap having removable mounting means for wrapping and maintaining the nameplate around the headband. The mounting means may be either a hook and loop type fastening device, snap fasteners, adhesive, or buttons.

Peters et al. '891 disclose a tubular sheath for placement over the strap of an adjustable cap which may be deformed in order to place the sheath over the strap and allow engagement of the two sections of the strap. The sheath is used to display a message or logo.

Unfortunately, all of the above-described accessories and their attachment means are fairly expensive to produce in bulk. Any rearwardly projecting mounting arms or bars must be specially molded, welded or otherwise affixed to the accessory. Of course, the same is true of snap fasteners or buttons, and hook and loop-type fasteners must be bonded or sewn onto the display panel. The additional materials and manufacturing steps inflate the unit cost, and the difference of a few pennies per unit can push the device outside the realm of commercial feasibility. This is particularly true when the device is intended as a premium give-away item. A "premium" item is typically given away to third parties in order to give a name or logo promotional exposure. The cost of premium items must be kept to a bare minimum or it becomes more cost effective to employ other means of advertising.

In partial solution, Rose '402 discloses a panel which carries a logo or advertisement, and which may be placed over the overlapping straps of an adjustable cap. The panel may be folded about its mid-point for sliding over the straps (FIGS. 17–18), or may be folded at the top and the bottom for enveloping the strap (FIG. 19). Alternately, a single U-shaped panel may be used with rolled edges for holding the panel on the straps (FIGS. 20–21). These embodiments may be produced at a very low unit cost, and are much more practical for their intended purpose. Nevertheless, they sacrifice certain structural advantages. Specifically, the Rose '402 device relies on the memory of the plastic to cling to the straps, and this is not always sufficient. Hence, the Rose '402 clips are somewhat prone to falling off. Moreover, any printed promotional design is constrained to the four comers of the panel.

It would be much more advantageous to provide a plastic panel of unitary construction which gives the ability to customize the shape of the panel to allow for more attention-grabbing advertisements, and which provides a locking mechanism to avoid the likelihood of the clip falling off. Of course, such enhancements must not significantly raise the cost.

SUMMARY OF THE INVENTION

In accordance with the above, it is an object of the present invention to provide a simple, inexpensive and convenient clip-on accessory which may be placed over the rear strap of an adjustable cap for conveying a promotional logo, trade name, slogan, advertisement or the like, or for attachment of a removable, interchangeable collectable such as a toy, plastic stick-on, sticker, magnet or the like.

It is another object to provide an accessory as described above which can be formed from a single sheet of plastic in a minimum of manufacturing steps to minimize the unit cost.

It is another object to provide an accessory as described above which includes a locking mechanism to secure itself to the cap strap and thereby avoid the risk of the clip falling off.

It is still another object to provide an accessory as described-above in which the shape of the display panel can be customized to provide more attention-grabbing advertisements It is still another object to provide an accessory as described above which includes an interchangeable display panel to allow for attachment of different promotional logos, trade names, slogans, advertisements or the like, or for attachment of a removable, interchangeable collectable such as a toy, plastic stick-on, sticker, magnet or the like.

It is another object to provide an accessory as described above which can be distributed in the form of a hang-tag attached to clothing or apparel by a swift tack.

According to the present invention, the above-described and other objects are accomplished by providing a promotional clip-on accessory for a cap strap. The accessory is die cut to form a substantially rectangular section of plastic or cardstock, and is scored to include a first pair of spaced parallel score lines substantially traversing a lower end to form a bi-fold hinge and lower panel adapted to fold up and around the back of the cap strap. In addition, a second pair of spaced parallel score lines traverse an upper end of the plastic section to form a bi-fold hinge and upper panel adapted to down and around the back of the cap strap. A display panel spans the upper and lower panels and is adapted to be carried on said cap strap for displaying promotional material.

To secure the accessory on the cap strap, a variety of locking tab configurations are disclosed, for example, in which a tab protrudes from one of the panels for insertion into a slit cut inside the other panel. Alternatively, one of the panels may be inserted and captured in a push-out locking tab cut into the other panel (by three contiguous cuts) to lock the accessory in position around the cap strap. Still other embodiments are shown including a tabbed configuration better suited for more rigid construction materials such as aluminum or other metal, and an interchangeable display panel.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

Figure 1:
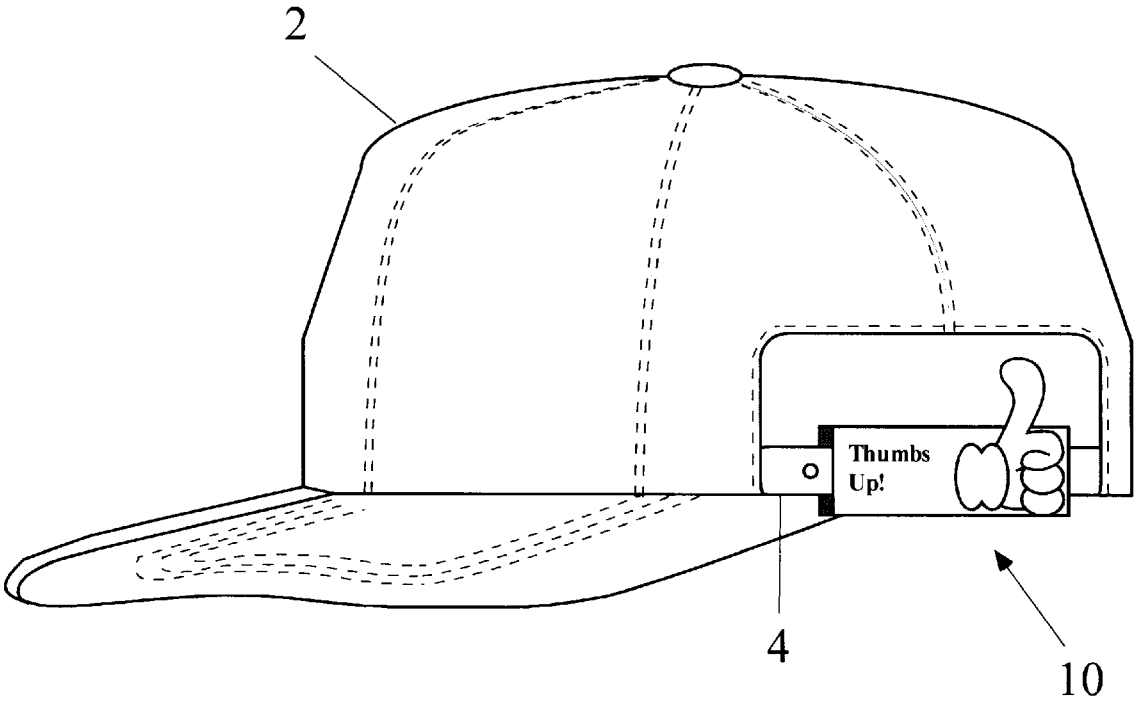
FIG. 1 is a rear perspective view of an exemplary adjustable cap 2 having a cap strap 4 with a clip-on promotional accessory 10 attached thereto in accordance with one embodiment of the present invention.

FIG. 1 is a rear perspective view of an exemplary adjustable cap 2 having a cap strap 4 with a clip-on promotional accessory 10 attached thereto in accordance with one embodiment of the present invention.

The adjustable cap 2 is a conventional baseball cap having a typical cap strap 4 for allowing adjustment of the cap size. The illustrated cap strap 4 comprises opposing plastic strips, one of which is defined by a series of spaced protruding posts running lengthwise, and the other of which is defined by a corresponding series of holes. To adjust the size of the cap, the strip with holes is drawn over the strip with posts and, when the cap is appropriately sized, the posts are pressed into the holes to maintain the size. It is noteworthy that many other types of cap adjustment straps exist, including unitary elastic straps, leather straps with buckles, etc. The present invention works well with all.

The clip-on promotional accessory 10 is a plastic cut-out which wraps around and envelopes the cap strap 4. It is applied by the wearer of the cap over the rear cap strap 4 for conveying a promotional logo, trade name, slogan, advertisement or the like, or for attachment of a removable, interchangeable collectable such as a toy, plastic stick-on, sticker, magnet or the like.

Figure 2:
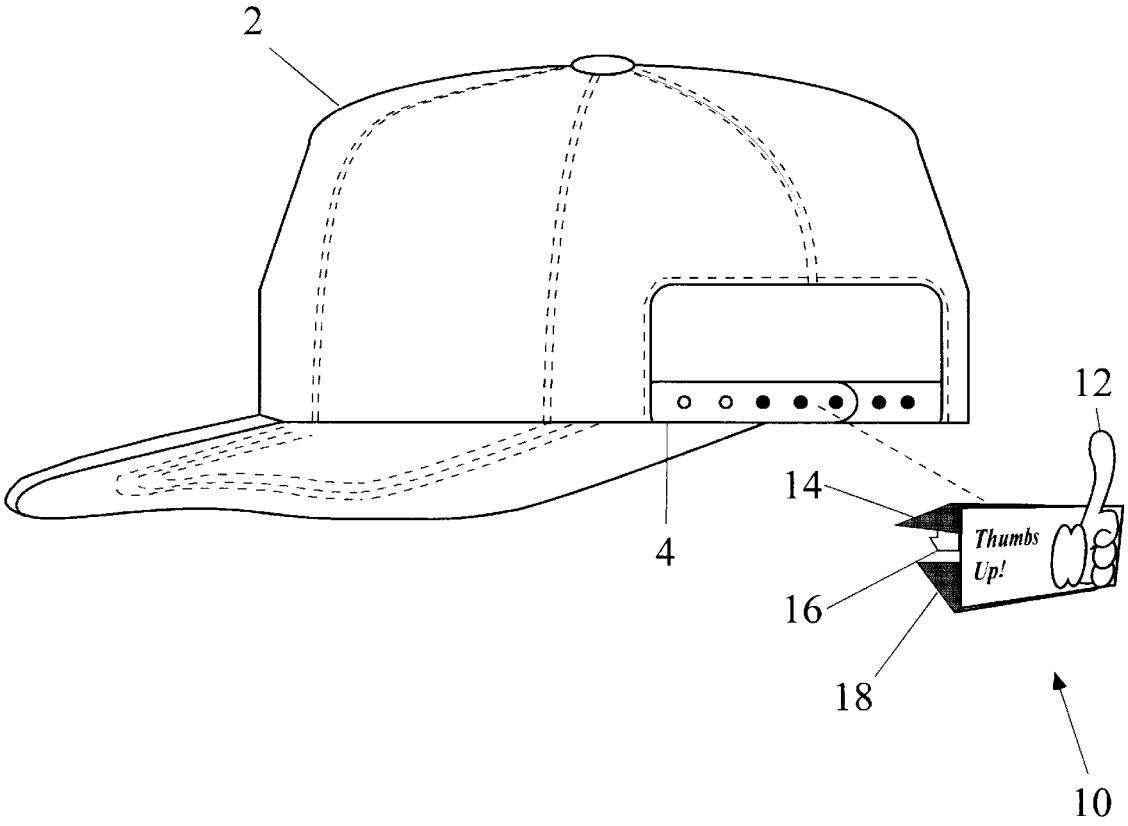
FIG. 2 is a rear break-away perspective drawing showing the clip-on promotional accessory 10 as in FIG. 1 removed from the cap strap 4.

FIG. 2 is a rear break-away perspective drawing showing the clip-on promotional accessory 10 as in FIG. 1 removed from the cap strap 4. The clip-on accessory 10 is preferably formed from a single sheet of vinyl plastic in a manner to be described. In application, accessory 10 is folded along score lines to envelope the cap strap 4. A lower panel 18 is folded up and around the back of the cap strap 4, and an upper panel 14 is folded down and around the back of the cap strap 4. A locking tab 16 is integrally formed to protrude from the upper panel 14, and tab 16 is inserted into a slit (to be described with reference to FIG. 3) to lock the accessory 10 in position around the strap 4. This exposes the front display panel, and a logo, trade name, slogan, advertisement or other indicia may be printed or otherwise attached thereon to convey promotional information. Alternatively, a collectible item such as a toy, temporary removable tattoo or the like may be attached to the front display panel. The design of the accessory (to be described with reference to FIG. 3) provides the capability to form a custom-shaped front display panel. This ability to form a custom-shaped front panel has not been achieved in the prior art, and it is exemplified by the protruding thumb 12 on the "Thumbs-Up" design shown. This capability helps greatly to achieve flashy and eye catching promotions.

Figure 3:
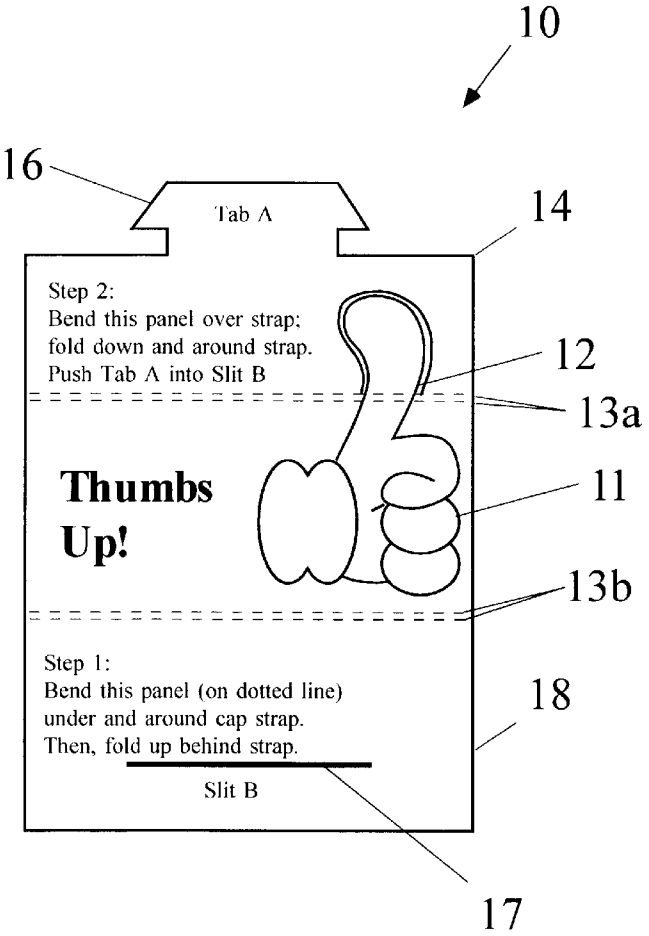
FIG. 3 is a front view showing the pattern of clip-on promotional accessory 10 of FIGS. 1 and 2 (prior to folding and application to the cap strap).

FIG. 3 is a front view showing the pattern of clip-on promotional accessory 10 of FIGS. 1 and 2 (prior to folding and application to the cap strap).

Typically, a first manufacturing step will entail printing artwork for a plurality of accessory 10 designs on a large single sheet of resilient thin-ply vinyl plastic or cardstock.

The silk-screened/printed sheet of plastic or cardstock is then dried in a kiln.

Finally, a plurality of clip-on promotional accessories 10 may be die cut in one pass from the single sheet. Each accessory 10 is die cut in the form of a substantially rectangular panel with a locking tab 16 protruding from one end. In this die-cut panel form, the accessories can be distributed as hang-tags attached to clothing or apparel by a swift tack.

As shown in the illustrated embodiment, the locking tab 16 may be cut as a stem-mounted frustum. The die cut also cuts a slit 17 lengthwise across a central portion of the sheet of plastic proximate the end opposing the locking tab 16. The extent of slit 17 generally conforms to the widest extent of locking tab 16 and, when the accessory is folded over and applied to a cap strap 4, locking tab 16 may be inserted through slit 17. In this manner, tab 16 and slit 17 serve to securely lock the accessory 10 in position around the strap 4. The resilient memory of the plastic or cardstock maintains pressure on the tab 16 and slit 17, and this secures the lock and eliminates the any potential for falling off.

Additionally, two pairs of score lines 13*a* and 13*b* are pre-scored lengthwise across the plastic panel of the accessory 10. The score lines may be imparted during the same die cutting step, or they may be applied in a second subsequent manufacturing step. The position of score lines 13*a* define the extent of the upper panel 14 relative to the display panel, while score lines 13*b* define the extent of the lower panel 18 relative to the display panel. While dimensions may vary, it suffices if all three sections are substantially equally sized (exclusive of the extent of tab 16). The two score lines which make up each pair 13*a* and 13*b*, respectively, should be separated by a small distance (on the order of 1 mm). This creates a first bi-fold hinge whereby the lower panel 18 may be folded up and around the back of the cap strap 4, and a second bi-fold hinge whereby the upper panel 14 may be folded down and around the back of the cap strap 4. The bi-fold hinges help to traverse the cap strap to facilitate the folding application thereto. Thus, the two score lines of each pair 13*a* and 13*b* are preferably separated by approximately the thickness of the cap strap 4.

In accordance with the present invention, the die-cutting step described above may additionally impart one or more interim cuts to define the shape of the display panel, thereby allowing it to be enlarged and/or customized in order to provide larger and more attention-grabbing advertisements. In the illustrated embodiment, the interim cut is shown by line 12. The interim cut generally traces the outline of the logo design or indicia (here the thumb) as it protrudes past the front display panel. In addition, the score lines 13*a* and/or 13*b* are interrupted and do not traverse the interim cut/logo design (here the thumb) where it protrudes past the front display panel. Thus, when the upper panel 14 is folded down and around the back of the cap strap 4 along the pair of score lines 13*a*, the logo design (here the thumb) pops out and remains erect and coplanar with the front display panel. This gives the image of a front display panel which is custom cut in the shape of the logo, and it accentuates the design and provides for a more attention-grabbing advertisement.

Figure 4:
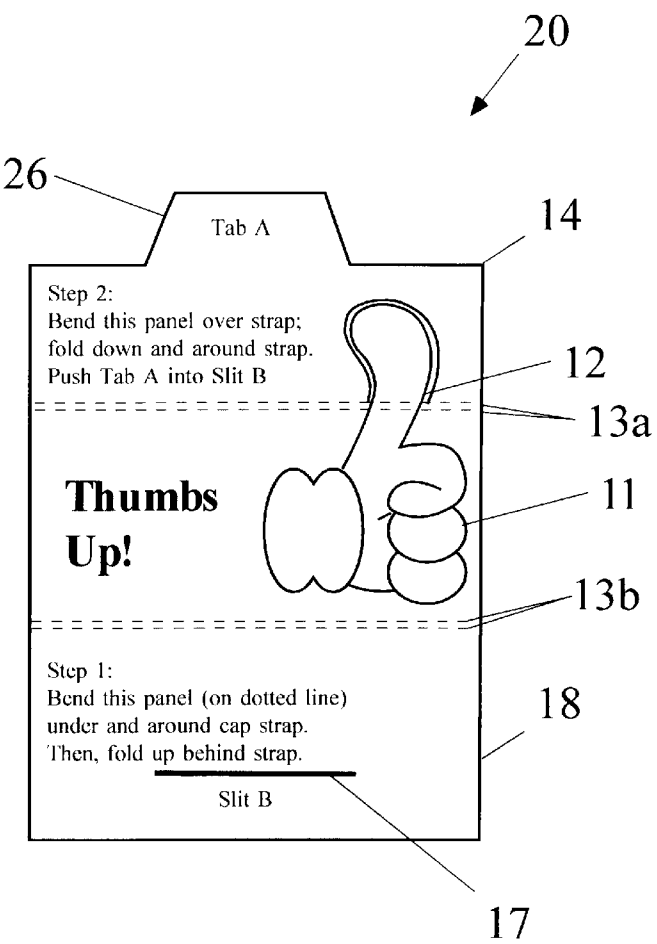
FIG. 4 is a front view showing the pattern for a clip-on promotional accessory 20 which employs an alternate locking tab configuration 26.

FIG. 4 is a front view showing a pattern for a clip-on promotional accessory 20 which employs an alternate locking tab configuration 26. The accessory of FIG. 4 is similar in most respects to that of FIGS. 1–3 except that the locking tab 26 of FIG. 4 is cut as a trapezoidal extension from upper panel 14 and is not mounted on a stem. While this configuration sacrifices some of the permanency of the lock, it becomes easier to insert the tab 26 into the slit 17.

Figure 5:
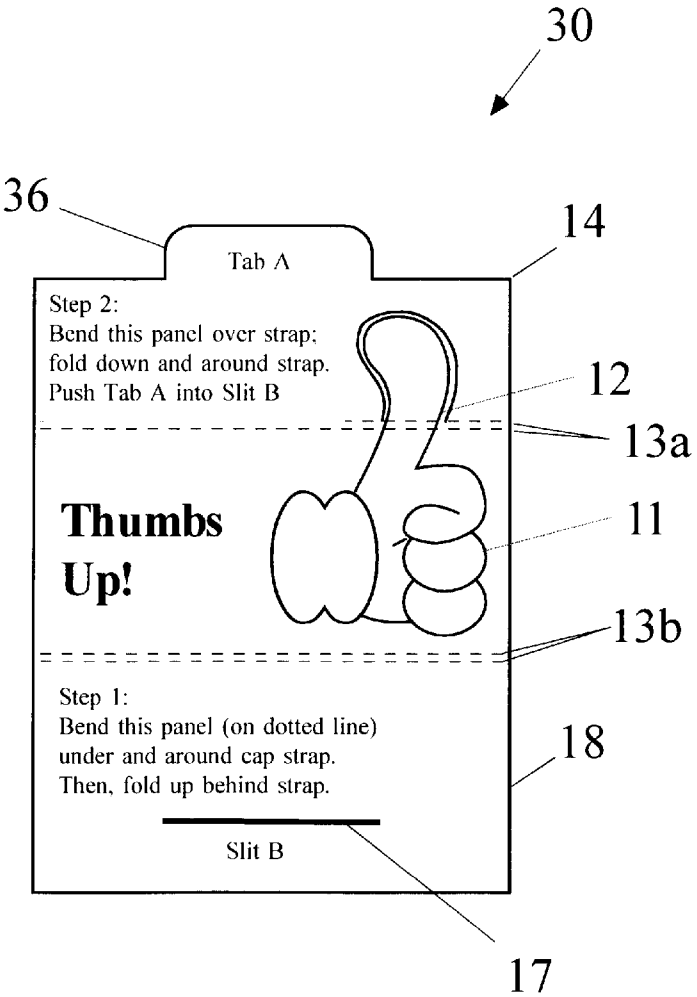
FIG. 5 is a front view showing the pattern for a clip-on promotional accessory 30 which employs another alternate locking tab configuration. 36.

FIG. 5 is a front view showing the pattern for a clip-on promotional accessory 30 which employs yet another alternate locking tab configuration 36. The accessory 30 of FIG. 5 is again similar in most respects to those of FIGS. 1–4 except that the locking tab 36 of FIG. 5 is cut in a substantially U-shaped extension from upper panel 14 (if desired, the tab 36 may be scored crosswise along the bottom). This makes it quite easy to insert the tab 36 into the slit 17, yet it increases the permanency of the lock.

Figure 6:
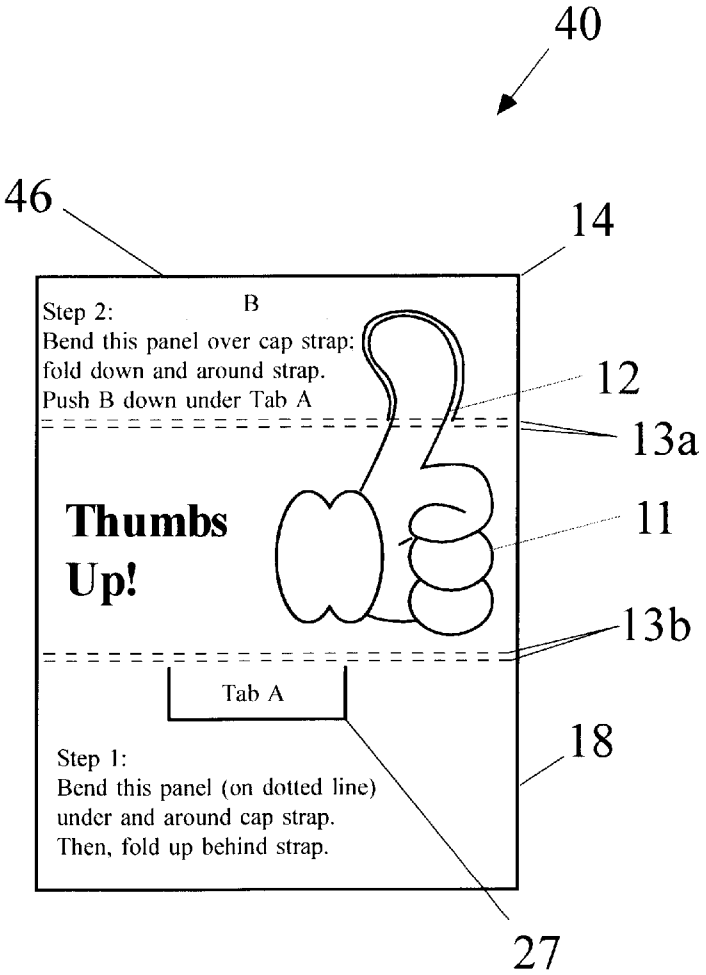
FIG. 6 is a front view showing the pattern for a clip-on promotional accessory 40 which employs yet another alternate locking tab configuration 27.

FIG. 6 is a front view showing the pattern for a clip-on promotional accessory 40 which employs an alternate single locking tab configuration. Once again, the accessory 40 of FIG. 6 is similar in most respects to those of FIGS. 1–5 except that a push-out locking tab 27 is formed on only one of the upper and lower panels 14, 18. Push-out locking tab 27 is preferably formed from three contiguous cuts forming a tab which opens along the outermost score line (here 13*b*) of the corresponding panel (here lower panel 18). In operation, the lower panel 18 is folded around and upward in back of the cap strap. The upper panel 14 is then folded around and downward in back of the cap strap 4, and the shaded area 46 is inserted behind and is held captive by the push-out locking tab 27 formed in the lower panel 18, thereby locking the accessory 40 in position around the cap strap 4.

Figure 7:
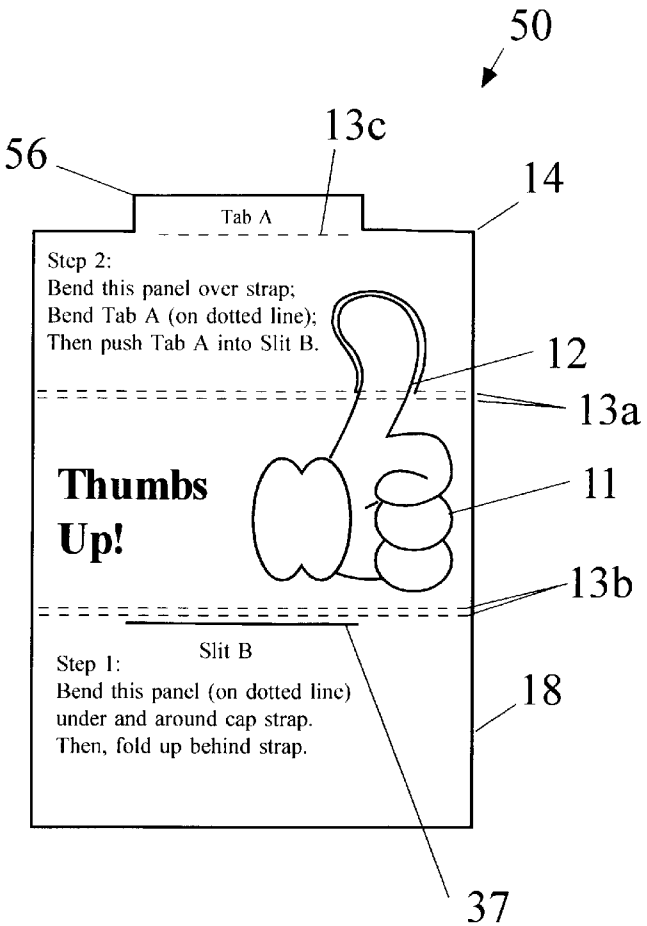
FIG. 7 is a front view showing another pattern for a clip-on promotional accessory 50 which employs another alternate locking tab configuration 56.

FIG. 7 is a front view showing the pattern for a clip-on promotional accessory 50 which employs yet another alternate locking tab configuration 56. The accessory 50 of FIG. 7 is again similar in many respects to those of FIGS. 1–6 except that the upper and lower panels 14, 18 are die cut with the same dimensions as the display panel. The locking tab 56 of FIG. 7 is cut as a thin rectangular extension from upper panel 14, and is scored crosswise along the bottom of the tab 56. A slit 37 is cut inside the lower panel 18 at the very bottom. First, the lower panel 18 is folded around and in back of the cap strap to expose the slit 37. The upper panel 14 is then folded around and downward in back of the cap strap and the tab 56 is inserted directly into the slit 37. Before the tab 56 is inserted in slit 37 the tab 56 is folded perpendicularly along the score line 13*c*. This facilitates insertion of tab 56 in slit 37, prevents the tab 56 from slipping out, and increases the permanency of the lock.

Figure 8:
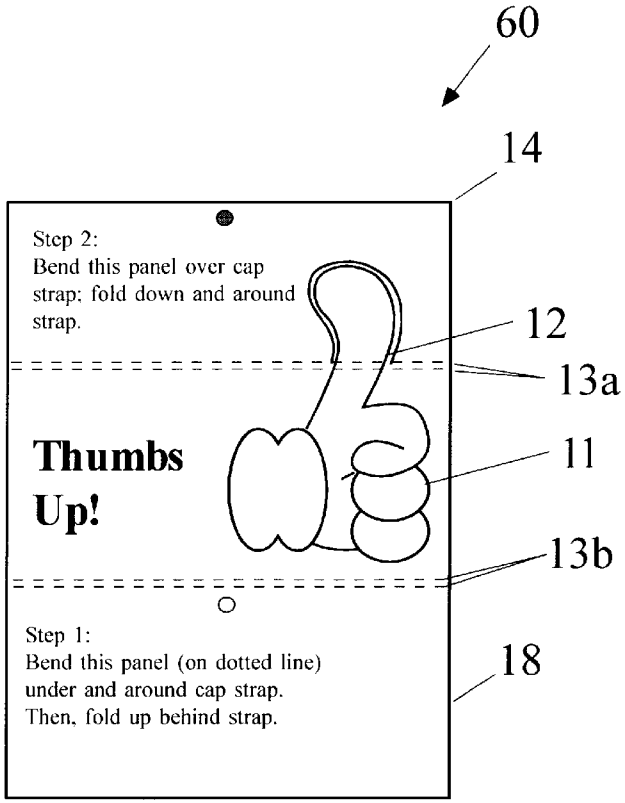
FIG. 8 is a front view showing the pattern for an alternate clip-on promotional accessory 60 which employs another alternate locking tab configuration including nipple 19 and hole 20.

FIG. 8 is a front view showing the pattern for an alternate molded clip-on promotional accessory 60. This embodiment employs a locking mechanism comprising a nipple 19 protruding from one of the upper and lower panels (here upper panel 14), and a corresponding hole or indent 20 protruding from the other of the upper and lower panels (here lower panel 18). In the illustrated embodiment, the nipple 19 is positioned toward the outer periphery of the upper panel 14 while the hole/indent 20 is positioned near the lower hinge formed by score lines 13*b*. In operation, the lower panel 18 is folded on its molded hinge around and upward in back of the cap strap. The upper panel 14 is then folded on its molded hinge around and downward in back of the cap strap 4, and the nipple 19 is depressed into and held captive by the hole/indent 20 formed in the lower panel 18, thereby locking the accessory 60 in position around the cap strap 4. The nipple 19 and hole 20 are formed in the original molding operation or in a subsequent embossing or cutting step, and both may take various forms. For example, the nipple 19 may instead be a simple punched tab or other protruding form.

It is also possible to omit any distinct locking mechanism and instead rely on the two molded hinges formed by pairs of score lines 13*a* and 13*b*, both folded around the strap at right angles, thereby maintaining the first bi-fold hinge (whereby the lower panel 18 may be folded around and upward in back of the cap strap 4) and second bi-fold hinge (whereby the upper panel 14 may be folded around and down in back of the cap strap 4) in their folded position. This embodiment relies on the outward pressure of the wearer's head to maintain the accessory in position. If this is not sufficient, it is also possible for the user to apply a patch of tape over the closed panels 14, 18 to secure them in place.

Figure 9:
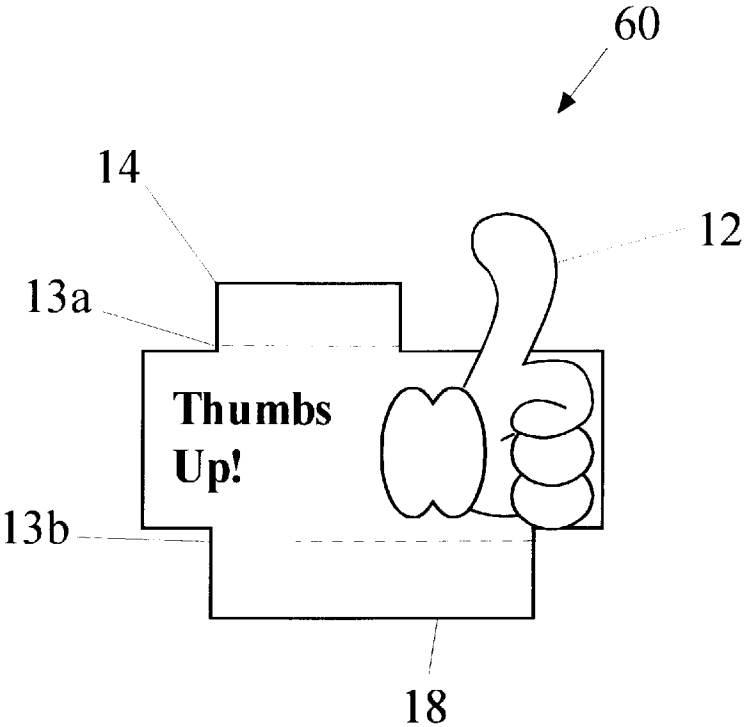
FIG. 9 is a front view showing the pattern for an alternate clip-on promotional accessory 70 which is better suited for more rigid construction materials such as aluminum or other metal.

FIG. 9 is a front view showing the pattern for an alternate clip-on promotional accessory 60 which is better suited for more rigid construction materials such as aluminum or other metal. This embodiment likewise omits any locking mechanism or score lines and instead relies on the formability of the metal to maintain the hinge (whereby lower panel 18 is folded up and around the back of the cap strap 4) and second hinge (whereby upper panel 14 is folded down and around the back of the cap strap 4) in their folded position. Score lines 13*a* and 13*b* are imparted to panels 14 and 19, respectively, and are slightly offset from the display panel.

It is also possible to mount an interchangeable design on the front display panel, thereby allowing for attachment of different promotional logos, trade names, slogans, advertisements, or collectible items.

Figure 10:
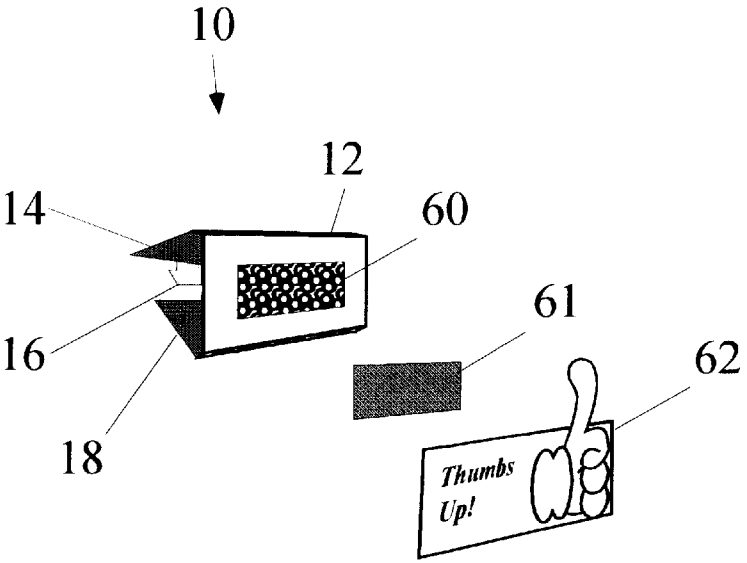
FIG. 10 is a front exploded view showing a pattern for a clip-on promotional accessory 10 as in FIG. 1 with an interchangeable display.

FIG. 10 is a front exploded view showing a pattern for a clip-on promotional accessory 10 as in FIG. 1 with an interchangeable display. Interchangeability is accomplished by printing the logo or indicia on a base layer of plastic or the like, or by using any carrier for display 62, and attaching a hook or loop strip 61 by glue or other suitable means to the back of the carrier 62. A mating hook or loop strip 60 is attached by similar means to the accessory display panel 12. This way, the carrier 62 can be removably secured to the front display panel 12 of accessory 10. Instead of hook and loop strips 60 and 61, the temporary attachment may be accomplished by using a specialized reattachable bonding agent such as that which is commercially available from 3M Corporation(®.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth in the appended claims.

We claim:

1. A clip-on promotional accessory for a cap strap comprising:

a section of sheet material cut and scored to further include a first pair of spaced parallel score lines substantially traversing a lower end of said section of sheet to form a bi-fold hinge defining a lower panel adapted to, fold around and downward in back of said cap strap, and a second pair of spaced parallel score lines substantially traversing an upper end of said section of sheet to form a bi-fold hinge defining an upper panel adapted to fold around and downward in back said cap strap, and a display panel between said upper and lower panels and adapted to be carried thereby on said cap strap for displaying promotional material, wherein said upper and lower panels are sized to overlap each other when folded and can be interlocked about said cap strap.

2. The clip-on promotional accessory for a cap strap, according to claim 1, further comprising:

a central slit cut across one of said upper and lower panels, a locking tab integrally formed to protrude from the other of said upper and lower panels and insertable into said slit to lock the accessory in position around the strap.

3. The clip-on promotional accessory for a cap strap according to claim 1 further comprising means for interlocking said upper and lower panels, said interlocking means including a push-out locking tab cut inside said lower panel;

said lower panel being adapted for folding around and in back of said cap strap; and the upper panel being adapted for subsequent folding around and in back of said cap strap and for insertion behind said push-out locking tab after folding said lower panel, whereupon said locking tab holds said upper panel captive to lock the accessory in position around the cap strap.

4. The clip-on promotional accessory for a cap strap according to claim 3, wherein the push-out locking tab is defined by orthogonal cuts inside said lower panel.

* * * * *